United States Patent [19]

Spivey

[11] 4,272,077

[45] Jun. 9, 1981

[54] GOLF CLUB PUTTER GRIP

[76] Inventor: Alice C. Spivey, Rte. 4 - Box 1385, Pell City, Ala. 35125

[21] Appl. No.: 38,681

[22] Filed: May 14, 1979

[51] Int. Cl.[3] ..... A63B 53/14

[52] U.S. Cl. ..... 273/81 R

[58] Field of Search ..... 273/73 J, 75, 77 R, 273/81 R, 81 B, 81.3, 81.4, 81.5, 81.6, 165; D21/222; 2/161 A, 169; 33/1 B, 2 R, 12, 174 D, 174 F

[56] References Cited

U.S. PATENT DOCUMENTS

| | | | |
|---|---|---|---|
| Re. 21,439 | 4/1940 | Link | 273/81.4 |
| 1,447,989 | 3/1923 | Kinsman | 273/81 R |
| 2,092,839 | 9/1937 | Gouverneur | 273/81.4 |
| 2,133,695 | 10/1938 | Hall | 273/81 R |
| 2,146,799 | 2/1939 | Davis | 33/2 R |
| 2,318,682 | 5/1943 | Fawick | 273/81 R |
| 2,429,351 | 10/1947 | Fetterolf | 273/81 R X |
| 2,627,410 | 2/1953 | Mishkinis | 273/81.3 |
| 2,781,196 | 2/1957 | Brandon | 273/81 B X |
| 3,173,689 | 3/1965 | Serblin | 273/81 R |
| 3,441,276 | 4/1969 | Garrity | 273/81.4 |
| 3,606,326 | 9/1971 | Sparks et al. | 273/81 R |
| 3,782,725 | 1/1974 | Giambazi | 273/81.3 |
| 3,837,647 | 9/1974 | Jacques | 273/81 R |
| 4,058,312 | 11/1977 | Stuff et al. | 273/77 A |
| 4,067,573 | 1/1978 | Key | 273/81.4 |
| 4,102,049 | 7/1978 | Harth | 33/174 D X |
| 4,115,873 | 9/1978 | Stansbury | 2/169 X |
| 4,160,327 | 7/1979 | Martin et al. | 33/2 R X |
| 4,173,074 | 11/1979 | Newman et al. | 33/2 R |

*Primary Examiner*—Richard J. Apley

*Attorney, Agent, or Firm*—Shlesinger, Arkwright, Garvey & Dinsmore

[57] ABSTRACT

A golf putter which improves putting by minimizing putter jerks or yipes by preventing the non-dominant hand from overriding the dominant hand, including a putter head connected to a shaft, a grip on the upper end of the shaft with the grip having a circumference substantially larger than that of the shaft diameter and having a diameter from 1 to 2 centimeters less than the distance between the tip of the index finger to the first bony prominence of the thumb joint, of the non-dominant hand. The method of manufacturing is also included.

12 Claims, 8 Drawing Figures

38

| GRIP SIZING CHART | | |
|---|---|---|
| GLOVE SIZE | X-FACTOR CM. | GRIP (circumference) CM. |
| WOMEN SM. & MED. | 12 or > 10 | 10 |
| WOMEN LARGE & MENS SM. | 14 or > 12 | 12 |
| MEN MED. & LARGE | 16or > 14 | 14 |
| MEN X-LARGE | 17or > 15 | 15 |

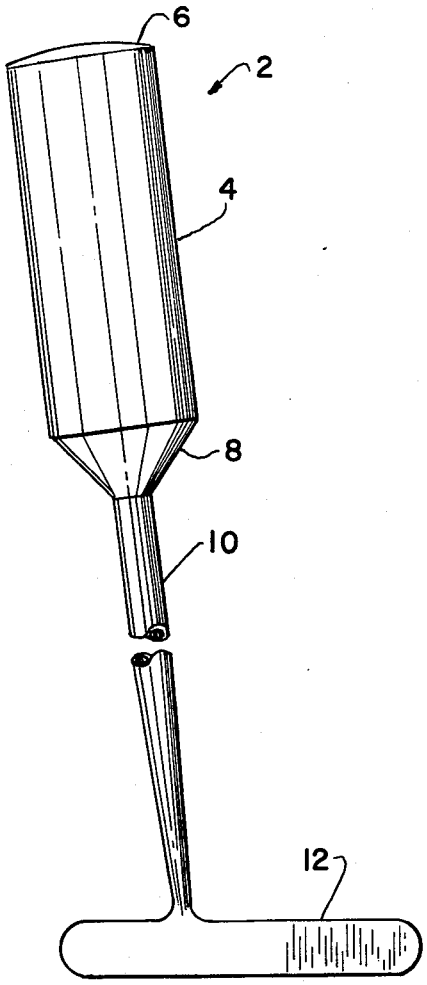
FIG 1
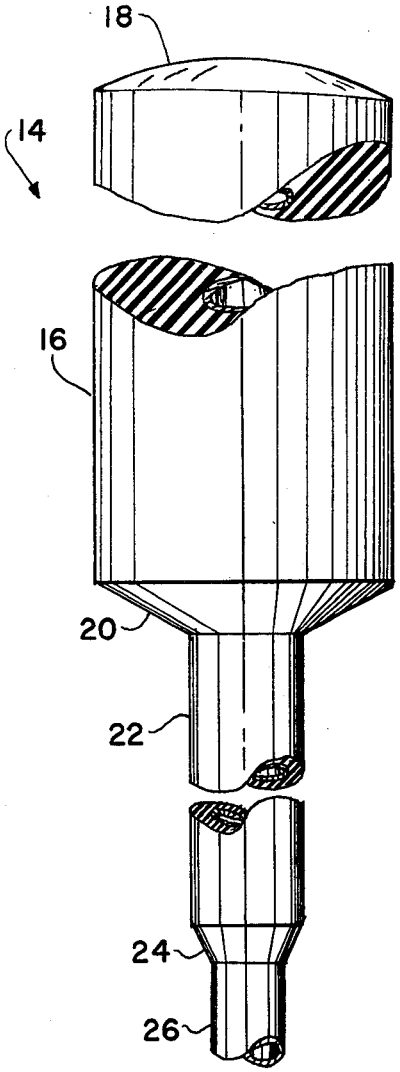
FIG 2
FIG 3
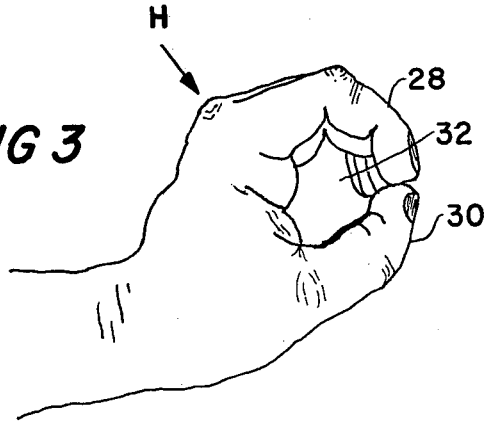

38

| GRIP SIZING CHART | | |
|---|---|---|
| GLOVE SIZE | X-FACTOR CM. | GRIP (circumference) CM. |
| WOMEN SM. & MED. | 12 or >10 | 10 |
| WOMEN LARGE & MENS SM. | 14 or > 12 | 12 |
| MEN MED. & LARGE | 16or > 14 | 14 |
| MEN X-LARGE | 17or >15 | 15 |

GOLF CLUB PUTTER GRIP

This invention relates to golf putters which are designed to improve the user's ability and reduce the number of putting strokes a golfer takes. In particular, this invention is aimed at customizing a golf putter club grip to a specific individual by taking into account certain measurements of the user's non-dominant putting hand.

BACKGROUND AND OBJECTS OF THE INVENTION

The normal golf putter has a grip which is constructed with the diameter slowly increasing from bottom to top to produce a cone shaped handle which is unrelated to the physical differences in golfers whether men, women or children. Examples and measurements used in making such a handle can be found in many golf books and in particular, Maltby's Golf Club Repair Manual. The use of such a handle in a golf putter does not take into account variations in hand sizes of the non-dominant putting hand and thus adversely effects the putting motion of the dominant hand when the muscles in the hand are not in equilibrium. Golfers have been aware of the fact that when putting, the dominant hand grips the putter tightly, whereas the non-dominant hand is used to balance and guide the putter, so as not to override the dominant hand. Until this invention, no putter had been devised to keep the non-dominant hand in its most relaxed muscular condition.

The present invention by using a formula determined by hand sizes, forces the grip of the non-dominant putting hand to be in a relaxed position so that it does not pull against the putting motion of the dominant hand.

It is therefore an object of the present invention, to provide a golf putter which increases accuracy and cuts down the number of strokes.

Another object of the present invention is to provide a golf putter grip which enables the non-dominant hand to be in a muscle relaxed position during putting while providing additional support and balance.

It is still a further object of the present invention, to provide a golf putter which is customized for the golfer using measurements of his non-dominant hand.

A further object of the present invention is to provide a method whereby a golf putter club can be constructed to enable the user to improve his putting.

Yet another object of this invention is to provide a golf putter which can be readily manufactured in different sizes to fit various grips.

A further object of this invention is to provide a golf putter which improves the golf game by increasing accuracy thus reducing the number of putting strokes needed in a round of golf.

Another object of this invention is to provide a golf putter which permits the dominant hand to follow through on a putting stroke without the non-dominant hand freezing on the club and overriding the dominant hand causing an interruption or jerk in the smooth putting stroke.

DESCRIPTION OF THE DRAWINGS

FIG. 1 is a typical side elevational view of a golf putter which incorporates the present invention showing indeterminant length.

FIG. 2 is a fragmentary side elevation view of a golf putter club showing portions in section of an alternate configuration of the present invention.

FIG. 3 is a schematic diagram of a non-dominant hand in the relaxed position.

FIGS. 1 and 2

FIG. 1 shows the golf club putter 2 which incorporates an enlarged grip 4. The grip 4 includes an end button 6 generally cylindrical and includes a short tapered or conical lower section 8. The tapered lower section 6 provides for a smooth transition 8 between the thin golf club shaft 10 and the enlarged grip 4. As in standard practice, the golf putter head 12 is connected to the lower portion of the putter shaft 10. In this embodiment, the grip 4 should be sufficiently long to accomodate both hands if necessary but at least the non-dominant hand. The length of the shaft 10 may vary with different golfers as desired.

Figures 4, 5:
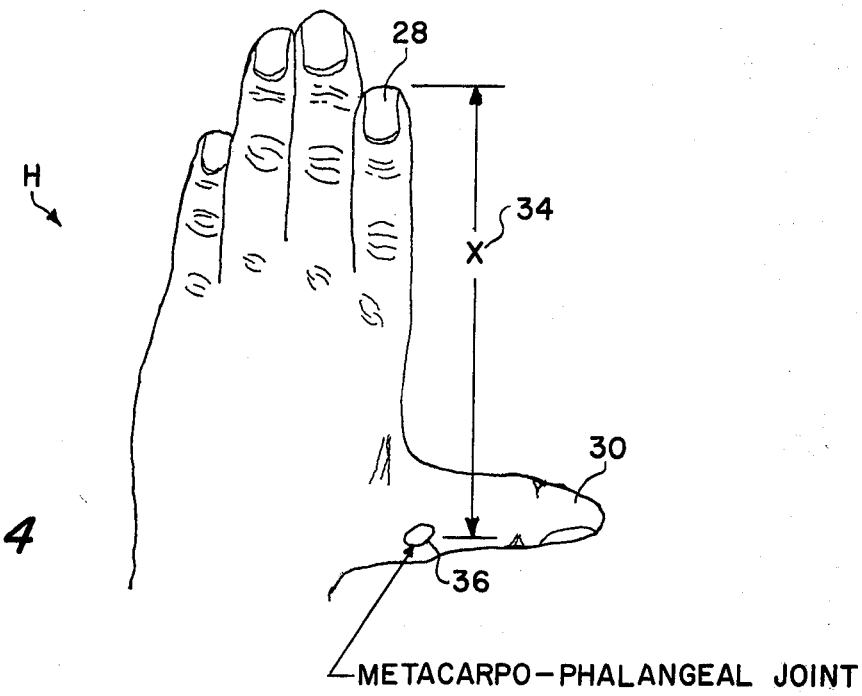
FIG. 4 is a schematic diagram of a non-dominant hand with the thumb at a right angle to the index finger of that hand.
FIG. 5 is a grip sizing chart for the present invention.

An alternate arrangement as shown in FIG. 2, shows the upper section of a golf putter club 14. The upper section 14 incorporates the enlarged grip 16 which has an end button 18 and a short tapered transition section 20. The outer shaft 22 serves as a grip to the dominant hand. The tapered section 24 serves as a transition between the larger diameter of the outer shaft 22 and the smaller diameter of the golf club 26. The grip material in both FIGS. 1 and 2 may be of any standard grip material such as leather, rubber, etc. and wrapped or fitted on the end of the shaft 22.

FIG. 3

FIG. 3 shows a hand H in the natural relaxed position without grasping a putter. The index finger 28 and the thumb 30 define a generally circular area 32 when the hand is relaxed. In this relaxed position, the muscles (not shown) in the hand H are in equilibrium, i.e. there is no tension on one side of the hand or the other. During putting, if these muscles become unbalanced, jerking during the putting stroke will result.

FIGS. 4 and 5

FIG. 4 shows a person's hand H in the position necessary for taking the required measurements. This position is with the thumb 30 at a right angle to the index finger 28. With the hand in the above described position, the X factor measurement 34 is defined as the distance between the tip of the index finger 28 and the first bony prominence of the metacarpo phalangeal joint 36 of the thumb 30.

FIG. 5 is a grip sizing chart in centimeters which relates the X factor measurement of FIG. 4 to that of the required circumference of the golf putter grip shown in FIGS. 1 and 2. This chart also relates the typical glove sizes to both the X factor and the grip circumference.

Figure 6:
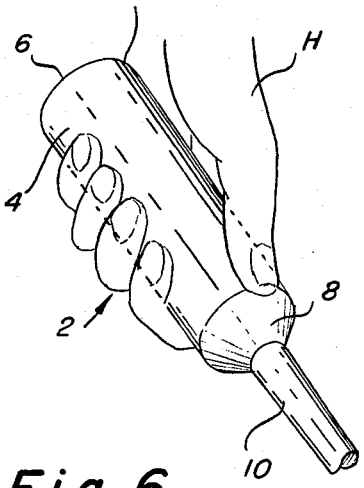
FIG. 6 is a schematic diagram showing the non-dominant hand gripping the golf putter grip.
Figure 7:
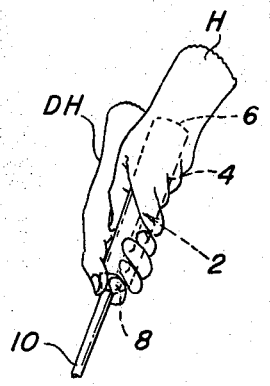
FIG. 7 is a schematic diagram showing both the non-dominant and the dominant hand positioned around the golf club putter grip.
Figure 8:
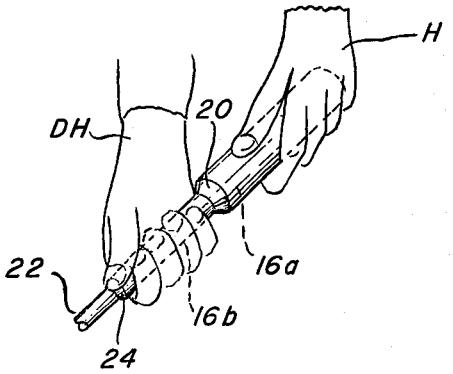
FIG. 8 is a schematic diagram of the alternate embodiment showing the non-dominant hand and the dominant hand gripping the golf putter grip.

FIGS. 6, 7 and 8

FIG. 6 shows a person's non-dominant hand H gripping the enlarged grip 4. The dominant hand DH as is best shown in FIG. 7, is positioned below the non-dominant hand H. The dominant hand DH extends past the lower end of the enlarged grip 4 to also grip the tapered transition section 20.

FIG. 8 shows a person's non-dominant hand H gripping the enlarged grip area 16*a* while the dominant hand DH grips the lower cylindrical reduced diameter grip 16*b*.

OPERATION

The operation of the invention is as follows: Referring now to FIG. 1, the golfer would hold his club as with the standard practice. That is with the non-dominant putting hand positioned above the dominant hand. The non-dominant hand would be gripping about the grip 4 on the golf club 2. The dominant hand would be positioned with the upper palm portion on the grip 4 and the lower portion on the tapered lower section 8 so that the thumb and index finger are adjacent the club shaft 10. The golfer would then putt as with the normal practice.

By having the non-dominant hand around the enlarged grip 4, the non-dominant hand is in the as near as possible medically speaking relaxed position approximating the fully relaxed position as indicated in FIG. 3. This position prevents the non-dominant hand from affecting the putting motion of the dominant hand.

In the alternate configuration as best shown in FIG. 2, the grip of the golf club has been modified to include a lower gripping section as indicated by 22 which provides a grip for the dominant hand. In using a putter with this grip, the golfer would grip the larger grip 16 with the non-dominant hand and have his dominant hand gripping the lower grip 22. The golfer would then putt as would be normal practice.

The diameter of the grip 4 as shown in FIG. 1, and the diameter of the grip 16 as shown in FIG. 2, is determined by the X factor of the user's hand. As best shown in FIG. 4, with the thumb 30 at a right angle to the index finger 28, the X factor is defined as the distance between the top of the index finger 28 and to the first bony prominence of the thumb joint (metacarpo phalangeal joint) less between about 1 and 2 centimeters.

As shown in FIG. 5, if the X factor is between 10 to 12 centimeters the grip circumference should be approximately 10 centimeters. If the grip is between 12 and 14 centimeters the grip circumference should be about 12 centimeters. If the X factor is between 14 and 16 centimeters the grip circumference should be about 14 centimeters. If the X factor is between 15 and 17 centimeters the grip circumference should be approximately 15 centimeters.

The chart 38 in FIG. 5 also gives approximate grip circumferences in centimeters for the different size of golfing gloves used. For example, for a woman's small and medium golf glove size, the grip circumference should be approximately 10 centimeters. While for a man's extra-large glove size, the grip circumference would be approximately 15 centimeters.

Although in both FIGS. 3 and 4 the left hand (non-dominant is shown as would be the case of a right handed golfer, it should be understood that in a left handed golfer the right hand would be the non-dominant hand and that the same procedures would apply only in reverse. Similarly, the upper hand is the non-dominant hand in all grip, even cross hand.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this inventions or the limits of the claims.

Having thus described my invention what I claim is:

1. A method for custom designing a golf club putter grip for a particular individual golfer so that the dominant hand may grip the putter tightly while enabling the muscles of the non-dominant hand to be in a muscle relaxed and muscle balanced position during putting so that the non-dominant hand will not override the dominant hand and freeze on the club during putting thereby causing an interruption or jerk in an otherwise smooth putting stroke, said method comprising the steps of:
   (a) positioning the non-dominant hand of the golfer such that thumb is at a right angle to the index finger;
   (b) measuring the distance in centimeters from the tip of the index finger to the first bony prominence of the thumb joint (metacarop phalangeal joint);
   (c) substracting approximately one to two centimeters from the above said measurement to make a final measurement circumference;
   (d) measuring the widths of the golfer's non-dominant and dominant hand;
   (e) forming a grip having a first generally cylindrical portion with a length at least equal to the width of the non-dominant hand and at least a portion of the dominant hand and having an outside circumference approximately equal to said final measurement.

2. A method as in claim 1 wherein step (c) comprises:
   (a) substracting one centimeter from the measurement of the distance between the tip of the index finger and the first bony prominence of the thumb joint.

3. A method as in claim 1 wherein step (c) comprises:
   (a) substracting two centimeters from the measurement of the distance between the tip of the index finger and the first bony prominence of the thumb joint.

4. A method as in claim 1 wherein forming said grip includes the steps of:
   (f) forming a second generally cylindrical portion adjacent to said first generally cylindrical portion with said second generally cylindrical portion having a grip length at least equal to the width of the dominant hand and a circumference substantially less than the circumference of said first generally cylindrical portion.

5. A custom designed golf club putter grip by the process of claim 1.

6. A method for custom designing a golf club putter grip for a particular individual golfer so that the dominant hand may grip the putter tightly while enabling the muscles of the non-dominant hand to be in muscle relaxed and muscle balanced position during putting so that the non-dominant hand will not override the dominant hand and freeze on the club during putting thereby causing an interruption or jerk in an otherwise smooth putting stroke, such method comprising the steps of:

(a) establishing the correlation between said golfer's individual glove size with its associated approximate grip circumference and setting it out in the following chart:

| GLOVE SIZE | GRIP (circumference) GM. |
|---|---|
| WOMENS SM. & MED. | 10 |
| WOMENS LARGE & MENS SM. | 12 |
| MEN MED. & LARGE | 14 |
| MEN X-LARGE | 15 |

(b) determining and selecting the appropriate glove size and grip circumference for said individual golfer from said chart;

(c) measuring the width of a golfer's non-dominant hand to determine the length of said grip, and (d) forming said grip with a first generally cylindrical portion having a length at least equal to the width of said non-dominant hand and a circumference as determined by said chart.

7. A method as in claim 6 wherein forming said grip includes the steps of:

(d) forming said first generally cylindrical portion with a second generally cylindrical portion adjacent and below said first cylindrical portion;

(e) forming said second cylindrical portion having an outside diameter substantially less than the circumference of said first generally cylindrical portion;

(f) forming said second cylindrical portion having a length approximately equal to the width of said golfer's dominant hand.

8. A custom designed golf club putter grip by the process of claim 6.

9. The method for custom designing a golf club putter grip for a particular individual golfer so that the dominant hand may grip the putter tightly while enabling the muscles of the non-dominant hand to be in a muscle relaxed and muscle balanced position during putting so that the non-dominant hand will not override the dominant hand and freeze on the club during putting thereby causing an interruption or jerk in an otherwise smooth putting stroke, said method comprising the steps of:

(a) establishing the correlation between progressive X factors (the distance between the tip of the index finger and the first bony prominence of the metacarpo phalangeal joint of the thumb) with their associated approximate grip circumference and setting it out in the following chart:

| X-FACTOR CM. | GRIP (circumference) CM |
|---|---|
| 12 or > 10 | 10 |
| 14 or > 12 | 12 |
| 16 or > 14 | 14 |
| 17 or > 15 | 15 |

(b) determining and selecting the appropriate grip circumference for said individual golfer from said chart as determined by the golfer's X factor;

(c) measuring the widths of the golfer's non-dominant and dominant hands;

(d) forming said grip with a length at least equal to the width of the said non-dominant hand, and (e) forming said putter grip with an outside circumference as determined by said chart.

10. The method of claim 9 wherein forming said grip includes the step of:

(e) forming said grip with a length including at least a portion of the width of said dominant hand.

11. The method of claim 9 wherein forming said grip includes the step of:

(e) forming a second generally cylindrical portion adjacent to said first generally cylindrical portion with said second generally cylindrical portion having a grip at least equal to the width of the dominant hand and a circumference substantially less than the circumference of said first generally cylindrical portion.

12. A custom designed golf club putter grip by the process of claim 9.

* * * * *